United States Patent [19]

Willard

[11] Patent Number: 4,721,051

[45] Date of Patent: Jan. 26, 1988

[54] TANDEM WINCH REELS

[76] Inventor: James E. F. Willard, P.O. Box 3244, Rte. AIA, Gulfstream, Fla. 33444

[21] Appl. No.: 812,130

[22] Filed: Dec. 23, 1985

[51] Int. Cl.[4] ..... B63B 41/00

[52] U.S. Cl. ..... 114/141

[58] Field of Search ..... 114/48, 51, 92, 102, 114/104, 127–143, 210, 293, 72, 254, 268, 365–377, 378–380; 212/89

[56] References Cited

U.S. PATENT DOCUMENTS 682,666 9/1901 Brown ..... 212/89

1,012,678 12/1911 Maly ..... 114/130

2,427,877 9/1947 Prince ..... 114/365

*Primary Examiner*—Joseph F. Peters, Jr.

*Assistant Examiner*—Jesûs D. Sotelo

*Attorney, Agent, or Firm*—Jon C. Christiansen

[57] ABSTRACT

A tandem-reel realignment winch system having two rotatable reels and a line wound around each of the reels. The line is wound in a first direction around the first reel and in a reverse direction around the second reel to compensate for the deviation in line alignment caused by the first reel. The winch system is adapted to raise and lower objects such as keels, anchors, bouys, mast riggings and the like.

12 Claims, 8 Drawing Figures

TANDEM WINCH REELS

INTRODUCTION

My invention is a tandem-reel realignment winch system which is capable of providing absolute true directional line (rope) alignment or a predetermined degree of line (rope) deviation. My invention further includes a winch and keel apparatus.

SUMMARY OF INVENTION

The tandem-reel realignment winch system of my invention has two reels and a means for rotating the reels. The tandem reels are cylindrical in shape and are in series. The axis of rotation of each cylindrical reel is parallel to the axis of rotation of the other cylindrical reel. A line (i.e. rope, wire, calbe, etc.) is wound around both of the reels. The winding of the line around the first reel in a first direction (e.g. from left to right) creates a deviation in line alignment which is compensated for (i.e. reduced or eliminated) by winding the line around the second reel in the reverse direction (e.g. from right to left). An equal number of windings (or turns) around each reel results in directional alignment of the line. By differing the number of windings (or turns) around the reels a degree of deviation results.

The tandem-reel realignment winch system is of marine type and is for marine purposes. The winch system can be used to raise and lower a centerboard keel. The winch system can also be used on boat decks, marine platforms, docks, ramps and the like to raise and lower objects such as anchors, bouys, mast riggings, signal towers and the like.

DETAILED EMBODIMENT OF THE INVENTION

Figure 1:
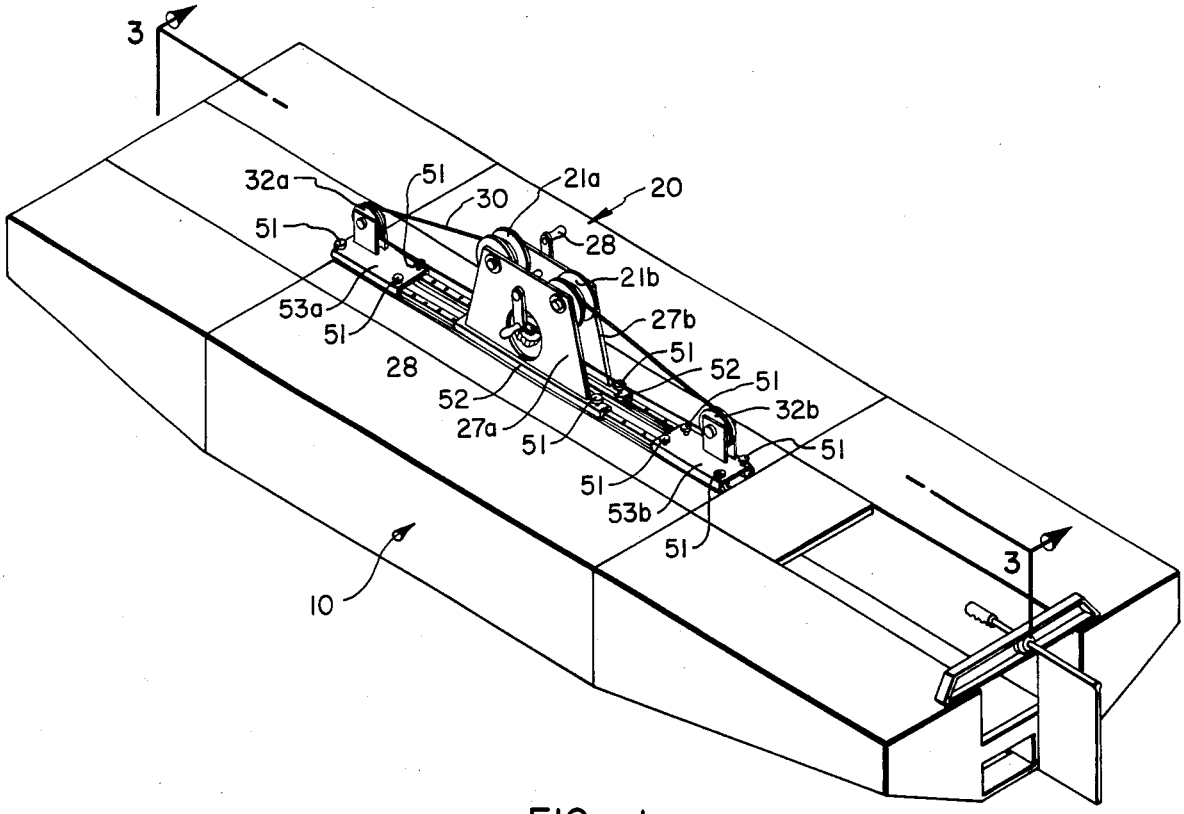
FIG. 1 depicts a tandem-reel realignment winch system on the deck of a boat hull.
Figure 2:
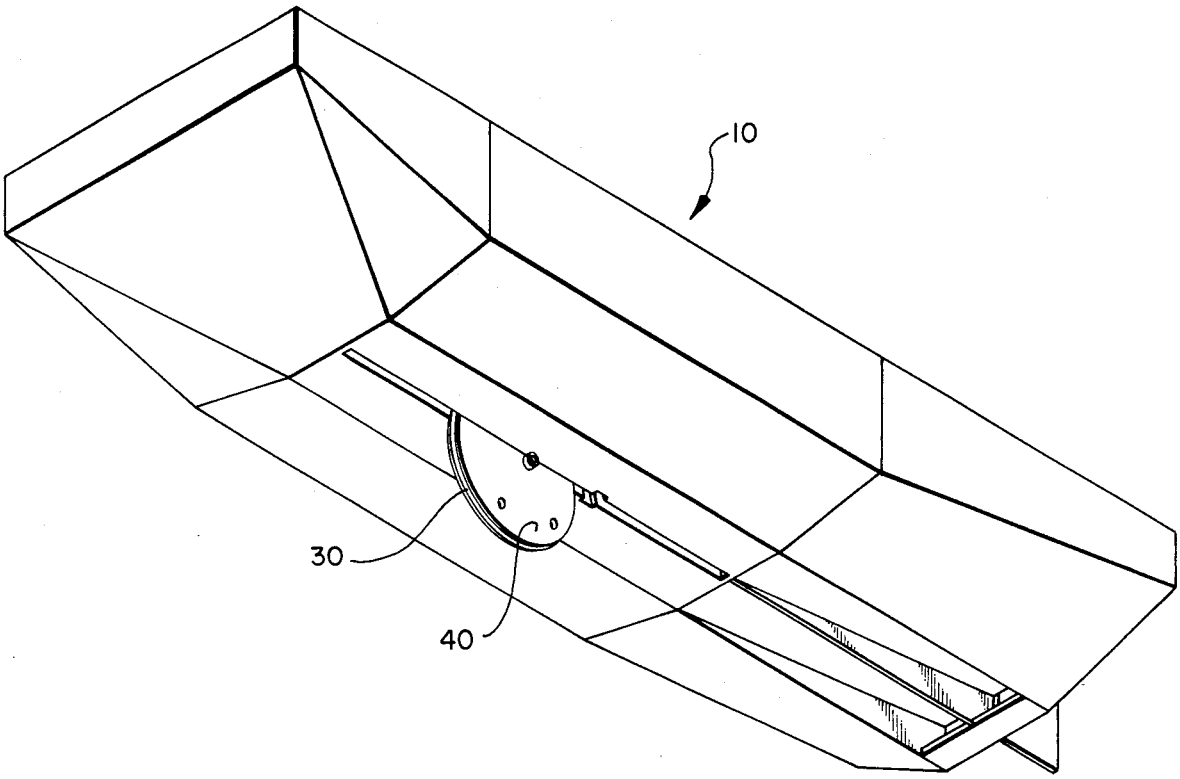
FIG. 2 depicts a bottom view of FIG. 1.

FIGS. 1 and 2 depict the hull 10 of a skow-like sailboat. The hull 10 is divided into nine primary watertight compartments made of 5/16" thick marine aluminum, all welded. Positioned on the deck of hull 10 and above the center compartment of the hull is an embodiment of the tandem-reel realignment winch system 20 of this invention. The system 20 includes twin tandem reels 21*a* and 21*b* in series. A stainless steel wire rope 30 (i.e. a "line") is wound around reels 21*a* and 21*b* and idler pulleys 32*a* and 32*b* and is used to move and position retractable centerboard keel 40. It should be noted that keel 40 is not shown in FIG. 1 in order to better illustrate other aspects of the invention. The keel is shown in FIGS. 2, 3, 4, 5, 7 and 8.

Figure 7:
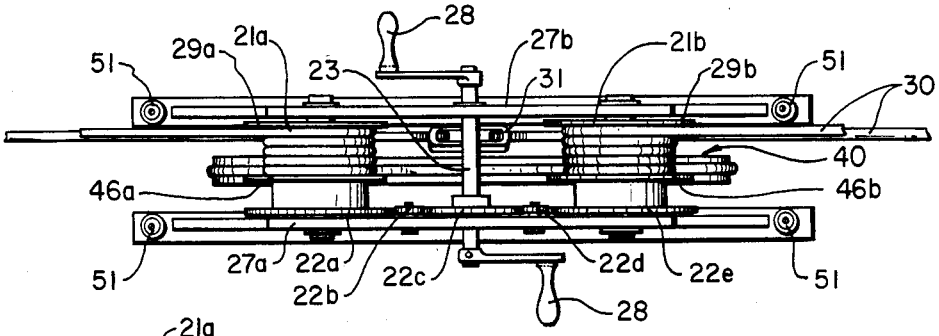
FIG. 7 depicts a view of the tandem-reel realignment system from above.
Figure 8:
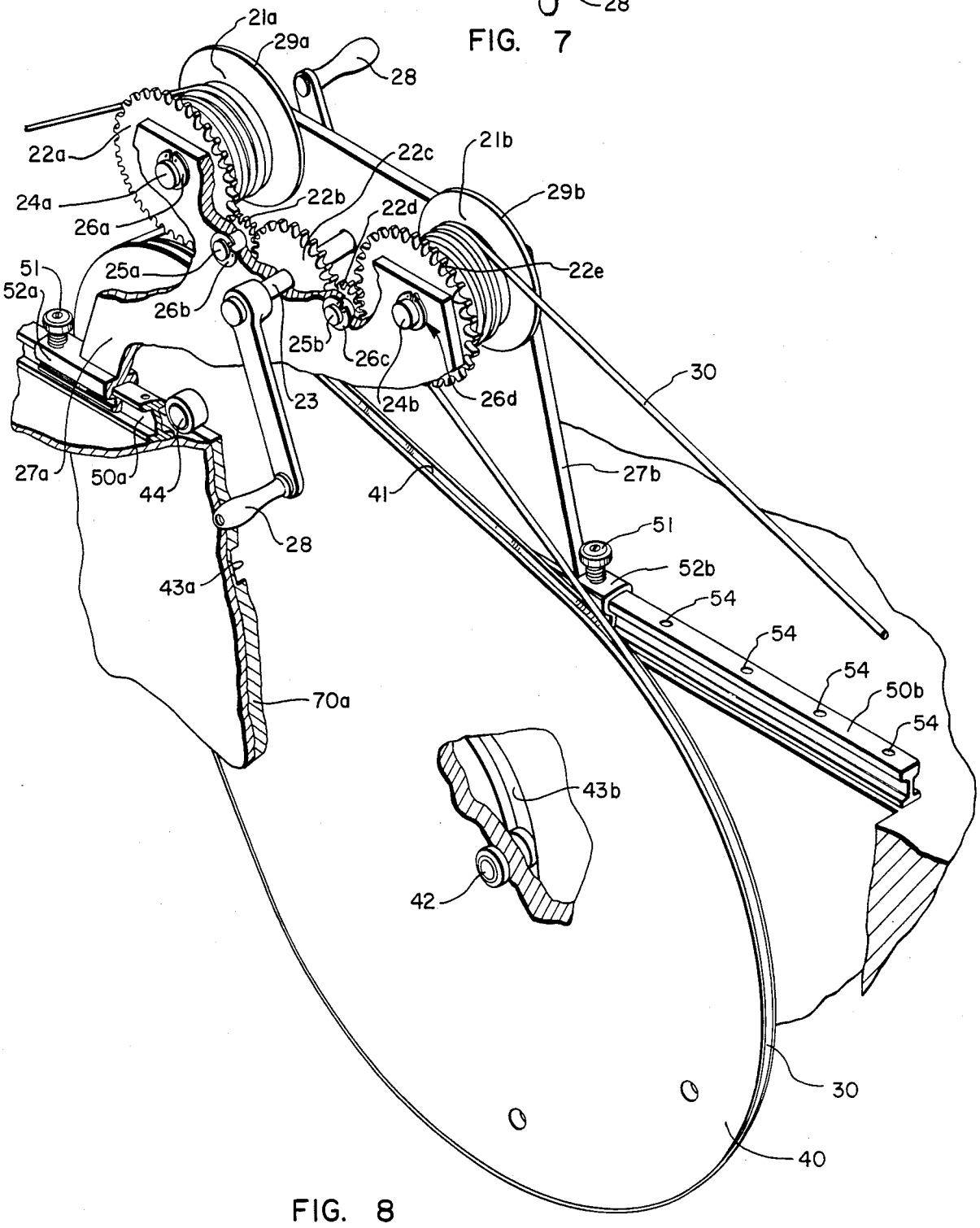
FIG. 8 depicts a detailed view of the tandem-reel realignment system, keel and track.

As shown in FIGS. 7 and 8, reels 21*a* and 21*b* are cylinders of the same diameter and length. Handle 28 provides a manual means for rotation of reels 21*a* and 21*b*. It should be noted that a motorized means of rotation can be used in lieu thereof. Handle shaft 23 is connected to sprocket gear 22*c*. Rotation of shaft 23 causes rotation of sprocket gear 22*c* which in turn causes rotation of idler sprocket gears 22*b* and 22*d* and sprocket gears 22*a* and 22*e*. Sprocket gears 22*b* and 22*d* are fixed to rotatable shafts 25*a* and 25*b*. Sprocket gears 22*a* and 22*e* are fixed to rotatable reel shafts 24*a* and 24*b*. Snap-lock washers 26*a*, 26*b*, 26*c* and 26*d* snap into an annular groove in each of shafts 24*a*, 24*b*, 25*a* and 25*b*. The shafts are positioned through and supported by metal plates 27*a* and 27*b*. Reel 21*a* has reel wall 29*a* and reel 21*b* has reel walls 29*b* (see FIG. 7). Rings 46*a* and 46*b* are positioned with set screws on reels 21*a* and 21*b*.

As shown in FIG. 8, side plates 27*a* and 27*b* are attached to parallel tracks 50*a* and 50*b* which run across the deck of hull 10. Attachment to tracks 50*a* and 50*b* is effected through journalled guides 52. Tandem-reel realignment winch system 20 can be moved fore and/or aft along tracks 50*a* and 50*b*. Locking screws 51 are used to lock journalled guides 52*a* and 52*b* to tracks 50*a* and 50*b*. Locking screws 51 are turned by hand into selected track holes 54. In this embodiment track holes 54 are 8" apart.

Idler pulleys 32*a* and 32*b* (see FIG. 1) are secured to the ends of tracks 50*a* and 50*b* by locking screws 51 and supports 53*a* and 53*b*. Supports 53*a* and 53*b* include journalled guides to secure them to tracks 50*a* and 50*b*.

Figure 6:
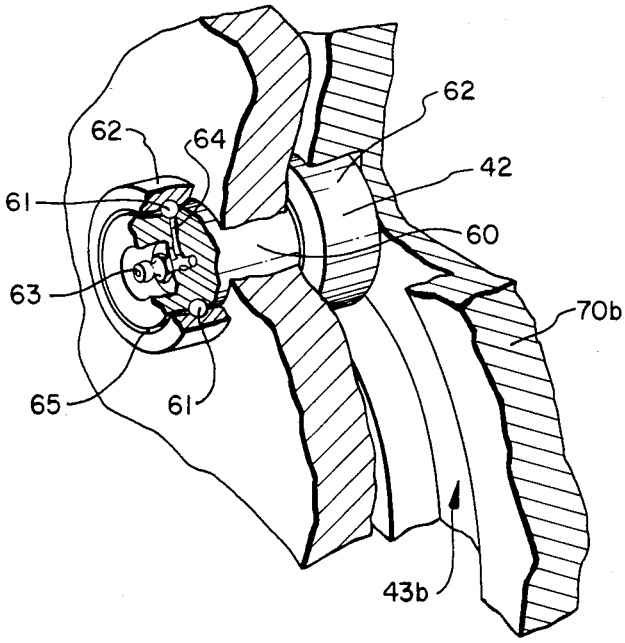
FIG. 6 depicts a view of the keel's center pin.

Keel 40 is curved at both ends. The curve at the end nearest the bow has an 18" radius. The curve at the end nearest the stern has a 27" radius. A center pin 42 is positioned in keel 40 at the center of the 27" curve. A deck pin 44 is positioned in keel 40 at the center of the 18" curve. FIG. 6 depicts center pin 42 in greater detail. Center pin 42 has an axle 60, ball bearings 61, race 62 (on each end), grease erk 63, grease channel 64 and race way 65. The races 62 are rotatable to facilitate movement. Deck pin 44, although longer in length, is of a similar construction.

Figure 5:
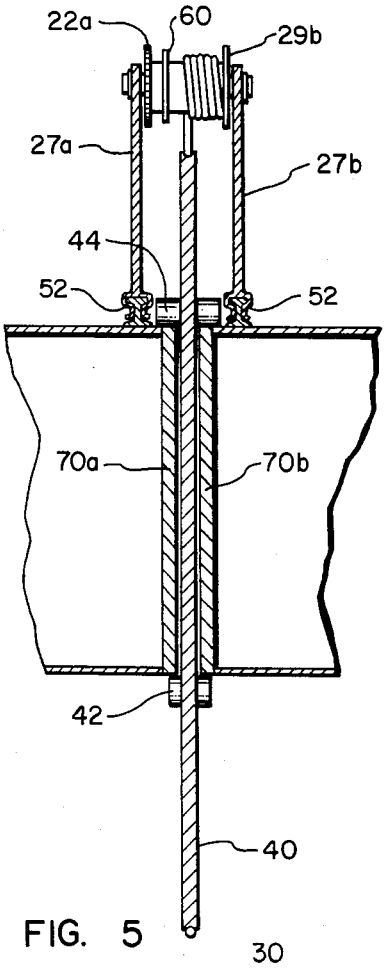
FIG. 5 depicts the keel between the keelson plates.

Keel 40 is positioned between keelson plates 70*a* and 70*b* (see FIG. 5). Keelson plates 70*a* and 70*b* include recessed centerboard keel tracks 43*a* and 43*b*. Recessed tracks 43*a* and 43*b* provide a track means along which center pin 42 can move.

A keel groove 41 runs the periphery of keel 40. Keel groove 42 is adapted to receive rope 30 (see FIG. 8). Turnbuckle 31 (see FIGS. 3, 4 and 7) can be used to adjust (tighten or loosen) the tautness of rope 40. Sweged ends of rope 30 are inserted into and held by turnbuckle 31. In FIG. 7 it is shown that rope 30 is wound around reel 21*a* in a first direction (in this case from reel wall 29*a* to ring 46*a*) which creates a deviation in rope (line) alignment. Rope 30 is wound around reel 21*b* in the reverse direction (in this case being ring 46*b* to reel wall 29*b*) to compensate for such deviation. The number of rope turns around reel 21*a* equals the number of rope turns around reel 21*b*. The portion of rope 30 that extends from reel 21*a* to keel 40 is aligned with that portion of rope 30 running from keel 40 to reel 21*b*. Such alignment keeps keel 40 parallel with keelson plates 70*a* and 70*b*. The portion of rope 30 running from pulley 32*a* to reel 21*a* is aligned with that portion of rope 30 running from reel 21*b* to pulley 32*b*.

Figure 3:
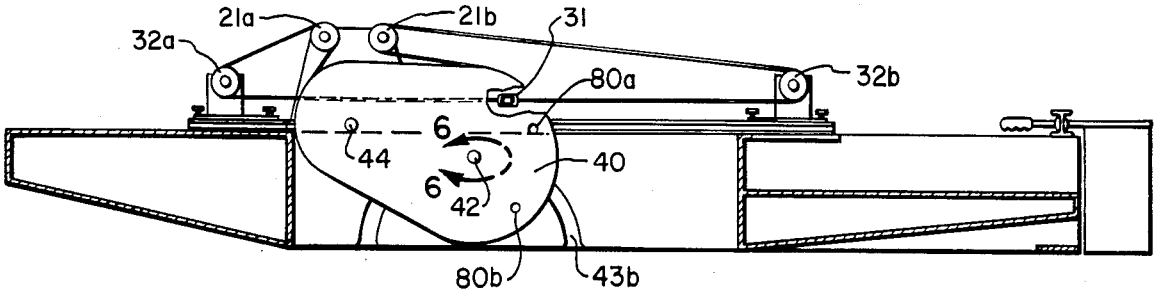
FIG. 3 depicts a keel in the fully raised position.
Figure 4:
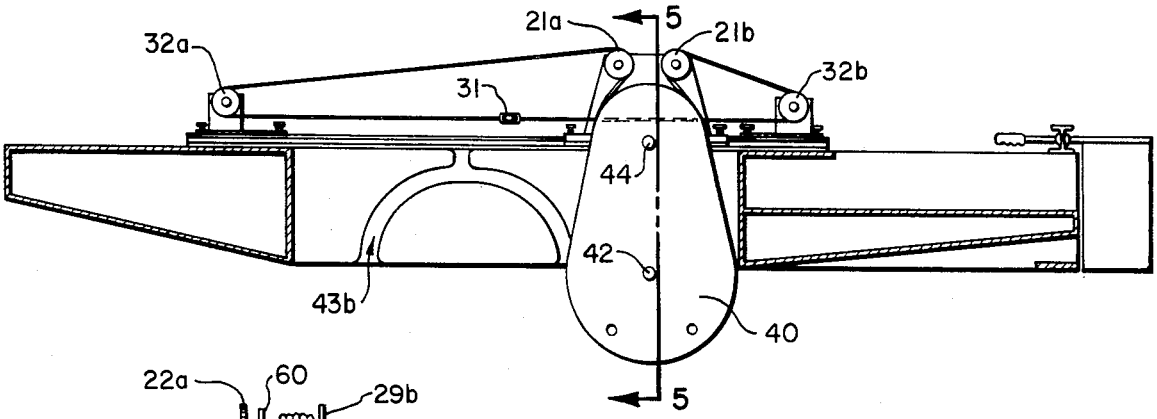
FIG. 4 depicts a keel in the fully lowered position.

Keel 40 can be raised by rotation of handle 28 in one direction and lowered by rotation of handle 28 in the reverse direction. FIG. 3 depicts keel 40 in a fully raised position. Note that a pin can be inserted through keel hole 80a to further secure keel 40 in fully raised position. FIGS. 2 and 4 depict keel 40 in a fully lowered position. As keel 40 is lowered from a raised position (FIG. 3) the reels 21*a* and 21*b* move along tracks 50*a* and 50*b* towards the stern (note: locking screws are raised), deck pin 44 moves along the hull deck and center pin 42 moves along the track means defined by recessed tracks 43*a* and 43*b*.

If desired, keel 40 can be secured at an intermediate position before it is fully lowered. When keel 40 is in the desired position, the locking screws are turned into the appropriate track holes 54 to fix the position of reels 21*a* and 21*b*. In this manner the keel 40 can be raised or lowered and the tandem reel realignment winch system positioned and fixed along the track means (i.e. tracks 50*a* and 50*b*).

If desired, the winch system 20, idler pulleys 32*a* and 32*b* and keel 40 can be reversed (turned 180°). In such case keel hole 80*b* (rather than 80*a*) serves as the pin-receiving hole for securing keel 40 in the fully raised position and the other portions of recessed tracks 43*a* and 43*b* are used for center pin 42 movement.

SUMMARY OF COMPONENTS

21*a:* reel (cylinder: 10″ long, 10″ diameter)
21*b:* reel (cylinder: 10″ long, 10″ diameter)
22*a:* sprocket gear
22*b:* idler spocket gear
22*c:* sprocket gear
22*d:* idler sprocket gear
22*e:* sprocket gear
23: handle shaft
24*a:* reel shaft (16″ long, 2″ diameter)
24*b:* reel shaft (16″ long, 2″ diameter)
25*a:* shaft (3½″ long, 1″ diameter)
25*b:* shaft (3½″ long, 1″ diameter)
26*a:* snap lock washer
26*b:* snap lock washer
26*c:* snap lock washer
26*d:* snap lock washer
27*a:* metal plate (28″ long at abase, 30″ height, 1″ thick)
27*b:* metal plate (28″ long at abase, 30″ height, 1″ thick)
28: handle
29*a:* reel wall
29*b:* reel wall
30: stainless steel wire rope (1⅛″ diameter)
31: tunbuckle (1½″ guage)
32*a:* idler pulley
32*b:* idler pulley
40: keel (stainless steel centerboard keep, 84¼″ long, 1⅝″ thick)
41: keel groove
42: center pin (2½″ long)
43*a:* keel track (3⅛″ wide - recessed into kellson plate 70*a*)
43*b:* keel track (3⅛″ wide - recessed into kellson plate 70*b*)
44: deck pin (8″ long, 3″ diameter)
46*a:* ring
46*b:* ring
50*a:* track
50*b:* track
51: locking screws (hand turned)
52*a:* journalled guides
52*b:* journalled guides
53*a:* idler pulley support
53*b:* idler pulley support
54: track holes (no threads - clear ¾″ diameter)
60: axle
61: ball bearings
62: race (3″ diameter)
63: grease erk
64: grease channel
65: race way
70*a:* keelson plate (8′ long, 3′ wide, ⅝″ thick)
70*b:* keelson plate (8′ long, 3′ wide, ⅝″ thick)
80*a:* keel hole
80*b:* keel hole The invention can, of course, vary from the specific details set forth in this Section and, accordingly, is within the scope of variations by persons of ordinary skill in the art. My invention, as I consider it, is defined in the appended claims.

I claim:

1. Apparatus comprising a tandem-reel winch system, a line and a centerboard keel; wherein said tandem-reel winch system comprises a first cylindrical reel, a second cylindrical reel in series with said first reel, and a means for rotating said reels; wherein said line is wound in a first direction around said first reel; wherein said line runs from said first reel around a substantial portion of the periphery of said keel to said second reel; wherein said line is wound in a reverse direction around said second reel; and wherein said keel can be raised or lowered by rotation of said reels.

2. Apparatus in accordance with claim 1 further comprising two keelson plates and a center pin in said keel; wherein a recessed track adapted to receive said center pin is formed in said keelson plates; wherein said center pin is positioned for movement in said recessed track; and wherein said center pin moves along said recessed track as said keel is raised or lowered.

3. Apparatus in accordance with claim 2 wherein said winch system is positioned on the deck of a boat hull and wherein said apparatus further comprises a track means allowing movement of said winch system along said deck.

4. Apparatus in accordance with claim 3 wherein said winch system further comprises two plates between which said reels are positioned and by which said reels are supported; wherein said track means comprises two parallel tracks running along said deck; wherein said plates can be secured to said tracks at various positions along said tracks by a securing means.

5. Apparatus in accordance with claim 4 wherein said securing means comprises a journalled guide attached to each of said plates and locking screews; and wherein said tracks include holes for receiving said locking screws.

6. Apparatus in accordance with claim 3 further comprising a deck pin positioned in said keel; wherein said deck pin provides support to said keel and moves along said deck as said keel is raised or lowered.

7. Apparatus in accordance with claim 3 further comprising two pulleys positioned on said deck; wherein said line is also wound around each of said pulleys.

8. Apparatus in accordance with claim 7 wherein the number of turns of said line around said first reel equals the number of turns of said line around said second reel thereby causing the portion of line running from said first reel to the first pulley to be aligned with the portion of said line running from said second reel to the other pulley.

9. apparatus comprising a tandem-reel realignment winch system and a centerboard keel; wherein said tandem-reel realignment winch system is adapted to raise and lower objects and is comprised of two reels in series, a means to rotate said reels and a line; wherein said line is wound in a first direction around one of said reels in a plurality of windings to create a deviation in line alignment; wherein said line is wound in a reverse direction around the other of said reels to compensate for said deviation; wherein the line of said winch system runs along a substantial portion of the periphery of said keel and provides support to said keel; and wherein said keel can be raised or lowered by rotation of said reels.

10. Apparatus in accordance with claim 9 wherein said winch system is moveable along a track means.

11. Apparatus in accordance with claim 9 further comprising two keelson plates and a center pin in said keel; wherein a recessed track adapted to receive said center pin is formed in said keelson plates; and wherein said center pin is positioned for movement in said recessed track.

12. Apparatus in accordance with claim 11 further comprising a deck pin positioned in said keel.

* * * * *